US010532254B1

(12) United States Patent
Evans et al.

(10) Patent No.: US 10,532,254 B1
(45) Date of Patent: Jan. 14, 2020

(54) LOW DRAG GOLF CLUB HEAD WITH IMPROVED MASS PROPERTIES

(71) Applicant: Cobra Golf Incorporated, Carlsbad, CA (US)

(72) Inventors: D. Clayton Evans, San Marcos, CA (US); Michael S. Yagley, Carlsbad, CA (US); Cameron J. Day, Vista, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 15/827,163

(22) Filed: Nov. 30, 2017

Related U.S. Application Data

(60) Provisional application No. 62/582,521, filed on Nov. 7, 2017.

(51) Int. Cl.
*A63B 53/04* (2015.01)

(52) U.S. Cl.
CPC .. *A63B 53/0466* (2013.01); *A63B 2053/0437* (2013.01); *A63B 2053/0491* (2013.01)

(58) Field of Classification Search
CPC ..... A63B 53/0466; A63B 2053/0437; A63B 2053/0491
See application file for complete search history.

(56) References Cited

U.S. PATENT DOCUMENTS 5,497,995 A * 3/1996 Swisshelm ..... A63B 53/04 473/350
5,989,134 A * 11/1999 Antonious ..... A63B 53/04 473/327
6,056,649 A * 5/2000 Imai ..... A63B 53/04 473/328
6,969,326 B2 11/2005 De Shiell et al.
7,361,100 B1 4/2008 Morales et al.
7,431,664 B2 10/2008 Meyer et al.
8,177,659 B1 5/2012 Ehlers
8,371,957 B2 * 2/2013 Schweigert ..... A63B 53/0466 473/324
8,568,247 B1 10/2013 Ehlers
9,492,721 B2 11/2016 Ghods et al.
9,504,889 B2 11/2016 Mitzel et al.
9,526,954 B2 12/2016 Oldknow
10,035,049 B1 * 7/2018 Nielson ..... A63B 53/0466
2003/0087710 A1 5/2003 Sheets et al.
2004/0116207 A1 6/2004 De Shiell et al.
2007/0155533 A1 7/2007 Solheim et al.
(Continued)

OTHER PUBLICATIONS

Hilton, 2012, Cobra golf release two new special edition drivers, The Sand Trap, published Aug. 5, 2012, on https://thesandtrap.com/b/bag_drop/cobra_golf_release_two_new_special_edition_drivers (8 pages).

*Primary Examiner* — Michael D Dennis
(74) *Attorney, Agent, or Firm* — Quarles & Brady LLP

(57) ABSTRACT

This disclosure describes golf club heads with optimized aerodynamics, in which a highly-lifted trailing edge minimizes drag, and in which a protruding element optimizes a location of a club head center of gravity. Features of the disclosure reduce drag forces on a club head during a golf swing and consequently reduce the work required to move the club head through the air. Thus, the club heads allow golfers to achieve faster golf swing velocities and increase golf shot distances.

8 Claims, 16 Drawing Sheets

(56) References Cited

U.S. PATENT DOCUMENTS

| | | | | |
|---|---|---|---|---|
| 2011/0165961 | A1* | 7/2011 | Cackett | A63B 53/0466 473/324 |
| 2012/0172147 | A1 | 7/2012 | McDonnell et al. | |
| 2013/0178305 | A1 | 7/2013 | Beno et al. | |
| 2013/0178306 | A1 | 7/2013 | Beno et al. | |
| 2017/0001082 | A1 | 1/2017 | DeShiell et al. | |
| 2017/0189770 | A1* | 7/2017 | Hettinger | A63B 53/0466 |

* cited by examiner

LOW DRAG GOLF CLUB HEAD WITH IMPROVED MASS PROPERTIES

CROSS-REFERENCE TO RELATED APPLICATIONS

This application claims the benefit of U.S. Provisional Patent Application No. 62/582,521, filed Nov. 7, 2017, incorporated by reference.

TECHNICAL FIELD

This disclosure relates to golf clubs.

BACKGROUND

Golf is a challenging sport and a social experience. Golfers of differing abilities enjoy playing together. Typically, any golfer—regardless of ability—desires the ability to make long and consistent shots. Some golf club designers have tried heel-toe mass distributions to give more consistent shots. Unfortunately, with existing clubs, the distance of a shot may be limited by extrinsic factors such as the maximum velocity of swing speeds. As such, within a group of golfers, stronger individuals will tend to have an advantage at making longer drives compared to other members of the group. Thus golfers will typically refer to handicaps to make score comparisons meaningful and to allow groups of golfers to enjoy golf together.

SUMMARY

The disclosure relates to golf club heads with aerodynamic properties optimized to make very long shots. Aerodynamic properties are optimized by means of a trailing edge of the club head being lifted very high in comparison to existing club heads, and in which the club head includes a protruding element, such as a strut with a weight on the ends extending down from the sole, to maintain an optimal center of gravity location despite the dramatically raked trailing edge. The dramatic upwards rake as the sole reaches the trailing edge reduces aerodynamic drag on a club head during a swing and thus reduces the work required for the club head to move through the air. Thus, the club heads allow golfers to achieve faster golf swing velocities and increase golf shot distances.

Embodiments of the present disclosure describe golf club heads having low drag and optimized center of gravity (CG) location by virtue of a raised trailing edge (compared to existing clubs). The club head is designed with a trailing edge positioned at a height, when the club head is at address, selected to minimize drag experienced by the club head during a golf swing, resulting in faster swing speeds. To offset any potential effect that the raised trailing edge may have on a location of the club head CG, the club head may include a weighted protruding element extending from a sole of the club head. The protruding weight positions the club head CG low and close to a neutral axis of the club (an idealized axis normal to, and extending through, a center of a ball-striking face of the club head). Additionally, the club head may have a crown that includes a lightweight material such as a composite, plastic, carbon fiber, etc., to contribute to lowering the club head CG.

Because the reduced drag provides faster swing speeds, more energy can be transferred to a golf ball resulting in ball impacts with greater ball velocity, lowered spin, and desired launch angle that also increases the overall distance the ball travels. Positioning the protruding weight member rearward on the sole can also increase a moment of inertia of the club head about a vertical axis when the club head is at address (MOIz). Due to the increased MOIz, energy transfer is optimized for off-center ball impacts on the club head's ball-striking face.

Advantageously, the design of each golf club head described herein reduces the drag force on the club head over a substantial portion of a golf swing and consequently reduces the amount of work required (e.g., ≤6 J) to move the club head through the air, along its path, by a maximum of about 40%. As such, a golfer can achieve faster swing velocities using the golf club head described herein because the reduced drag force on the club head requires less work from the golfer to move the club head through the air. The faster swing velocities result in a dramatic increase in energy transfer to a golf ball at impact because the kinetic energy (K) of any object (e.g., the golf club head) according to Newtonian physics has a quadratic relationship with the object's velocity (i.e., K=(½) mv^2). Furthermore, the design maintains an optimal club head CG and a high MOIz. Due to the optimal CG, shots go great distances and due to the high MOIz, the club head is forgiving to off-center hits, and shots consistently travel straight.

One aspect of the present disclosure provides a golf club head comprising a ball-striking face, a crown, sole, and the trailing edge. The crown extends back from a top of the ball-striking face and the sole extends back from a bottom of the ball-striking face. The trailing edge of the crown is defined by a meeting of the crown and the sole. The height of the trailing edge, as defined when the club head is at address, is selected to reduce drag the golf club head experiences during a golf swing.

In some embodiments, the height of the trailing edge can have a value that is greater than 30% and less than or equal to 95% (preferably between about 34 and 70%) of a crown-to-sole height of the golf club head as defined when the club head is at address. Additionally, the height of the trailing edge can be selected such that an amount of work required to achieve a golf club swing speed greater than or equal to 100 mph is less than or equal to 6 joules. In other embodiments, the reduced drag can be promoted by a delay in airflow separation occurring at a point closer to the aft of the club head than the leading edge of the crown.

The golf club head's center of gravity (CG) can be positioned to optimize energy transfer from the club head to a golf ball. In some embodiments, the golf club head comprises a protruding element coupled to the sole to position the club head CG. For example, the protruding element can position the CG within a few millimeters (mm) of an axis normal to and passing through a center point of the ball-striking surface. In certain examples, the CG can be positioned at most 3 mm, at most 2 mm, or between 2 mm and 3 mm from the axis. The CG can also be defined as being positioned about or on the neutral axis, which is perpendicular to a surface defined by the ball-striking face and normal to a center point of the ball-striking face. Although the neutral axis is not a physical component of the club head, a skilled artisan will understand that it is an idealized axis used to describe an orientation of the club head and a positional relationship between components of the club head.

The club head CG is influenced by a location and mass of the protruding element. For example, the protruding element can be coupled to an aft section of the sole and a weight of the protruding element can be selected to position the CG at a low point along and either on or about the axis. The protruding element can be coupled to the sole. Optionally, a weighted screw can couple the protruding element to the sole. The protruding element may have an aerodynamic design to minimize drag on the club head during a golf swing. Additionally, the protruding element can have a portion with density that is at least about 11 grams per cubic centimeter (g/cm^3) or greater. A material of the protruding element may be selected such that its density allows a size of the protruding element to be minimized, to minimize drag.

In other embodiments, the CG of the golf club head can further be positioned by at least one of: a weighted screw, a weight of a portion of the crown, and a weight of a body of the club head. For example, a portion of the crown may include a composite material. The composite material can have a weight that is less than that of the protruding element. The crown may be bonded to a body of the golf club head, which, in further aspects, can comprise a metallic material such as titanium. The body can comprise a material that has a density that is greater than a material of the crown, and less than a density of the protruding element.

Preferably, an MOIz of the golf club head is be optimized by an aft-ward placement of the protruding element. The MOIz may have a value that is greater than or equal to 4800 gcm^2.

In further embodiments, the golf club head can generate a sound that is greater than 3600 Hz in response to the ball-striking face impacting a golf ball. Also, a loft of the club head can be greater than or equal to 7 degrees, e.g., preferably, 10 degrees.

A second aspect of the disclosure provides a golf club head that comprises a ball-striking face, crown, sole, and trailing edge. The crown extends back from a top of the ball-striking face, and the sole extends back from a bottom of the ball-striking face. The trailing edge is defined by an aft-most point where the crown meets the sole. When the club head is at address, the trailing edge preferably has a height between about 30% and about 90% of a height of the club head, and more preferably between about 35% and 60%. The club head may include a protruding element coupled to the sole such that a club head CG is within a few millimeters (mm) of an idealized axis passing through a center of, and normal to, the ball-striking face (i.e., the neutral axis). The protruding element may be coupled to an aft portion of the sole. A feature on the protruding element may have a mass selected to position the CG at a low point along and either on or about the neutral axis. For example, the feature may be a weight member on the protruding element, the weight member comprising dense material such as tungsten. Optionally, the crown includes a lightweight material such as graphite, a thermoplastic, or carbon fiber. The crown may have a mass that contributes to positioning the CG close to the neutral axis. For example, the crown may be provided by a separate piece of material (e.g., carbon fiber, prepreg, thermoplastic, or graphite) that is bonded to a body of the golf club head. The skilled artisan will understand that any known mechanism can be used to bond the crown piece to the golf club head's body such as, for example, adhesives, screws, snap fit, or a friction fit. The club head body may include a metal such as titanium. The club head may include a weight member such as a screw coupled the protruding element to locate the club head CG at or close to the neutral axis.

The golf club head may have a loft of at least about ten degrees. Additionally, the golf club head height can be a vertical distance that is defined by horizontal projections of an apex of the crown and the nadir of the sole, when the club is at address. Preferably, the height of the trailing edge has a value that is between about 30% and about 90% of the club head's height. The height of the trailing edge can be selected such that an amount of work required to achieve a golf club swing speed greater than or equal to 100 mph is less than or equal to 6 joules.

DETAILED DESCRIPTION

One factor used in aerodynamics to characterize properties of flow of air around a club head is drag, which adversely affects the velocity profile of the club head. Thus, club head designs that lower the drag during golf swings provide better aerodynamics.

Provided herein are golf club head designs having a trailing edge height that reduces drag during a golf swing compared to existing club heads. To offset any raise in club head CG location, the club heads can be weight balanced using features such as a protruding element bearing a weight member or material selection such as lightweight composites or graphite for the crown. By such means, a club head CG is preferably very close to (within <2 mm of) a neutral axis of the club head. Additionally, positioning a weight member very near the aft of the club head provides the club head with a high MOIz, such that the club head is forgiving to off-center hits.

Advantageously, a raised trailing edge reduces drag on the club head by as much as 40% or even more during a golf swing and, consequently, reduces the amount of work required to move the club head through the air. Using a golf club fitted with a club head of the present disclosure, the club head can achieve swing speeds of 100 mph or greater, with work input of less than six Joules of energy. Thus, the club heads of the present invention display improved aerodynamic properties with maximum energy transfer characteristics that lead to faster swinging and longer, more consistent shots for golfers.

Figure 1:
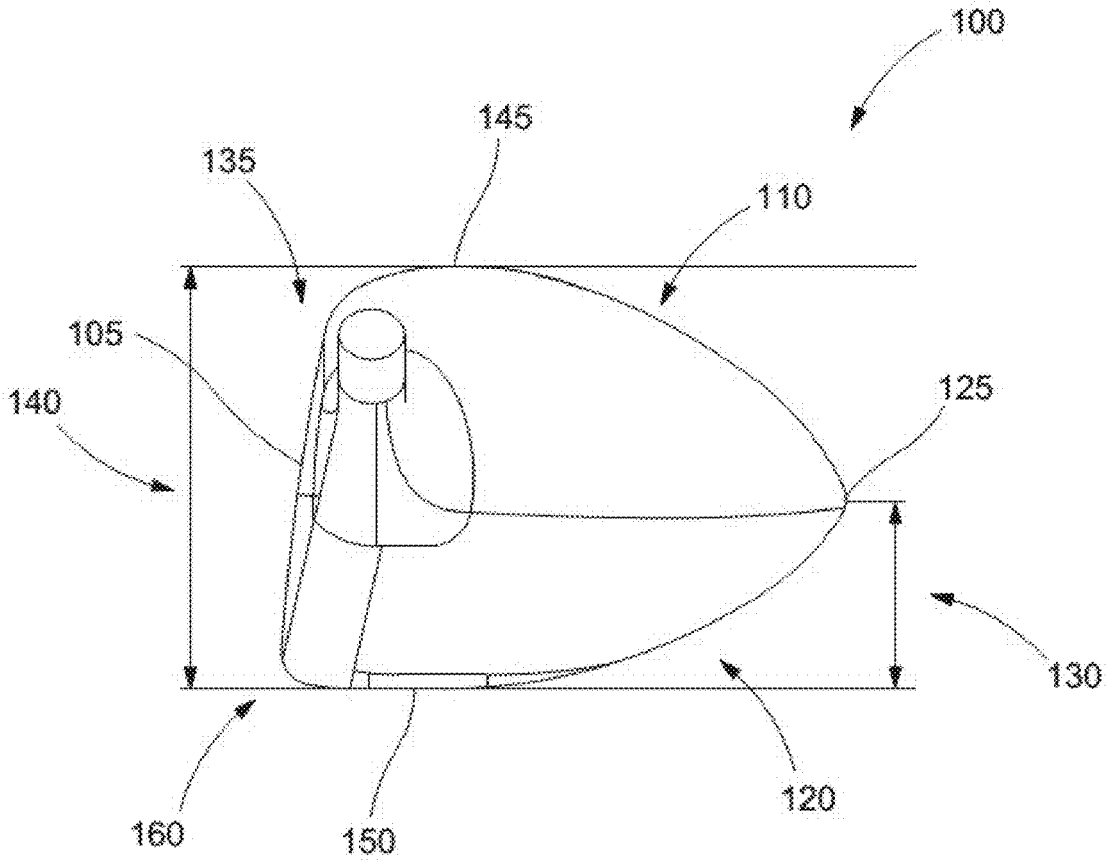
FIG. 1 is a side-view of a golf club head according to an example embodiment.

FIG. 1 is a side-view of a golf club head 100 with a raised trailing edge 125. The club head 100 includes a ball-striking face 105, a crown 110 that extends back from a top portion 135 of the ball-striking face 105, and a sole 120 extending back from a bottom portion 160 of the ball-striking face 105. The golf club head 100 further comprises a trailing edge 125 that is defined by a meeting of the crown 110 and the sole 120 at an aft section of the golf club head 100. The aft section is an area of the golf club head 100 that is distal from the ball-striking face 105. The trailing edge 125 has a height 130, as defined when the club head is at address, which is selected to reduce the drag experience by the club head 100.

The trailing edge 125 has a height 130 that is a function of the golf club head's height 140, which can also be defined as a vertical distance between horizontal projections of the crown's apex 145 and the sole's nadir 150. The apex 145 is the highest point of the club head 100, and the nadir 150 is the lowest point of the club head 100. Adjustments of the trailing edge height 130 with respect to the club head height 140 can reduce drag by almost 40%, and, as such, an amount of work to, e.g., less than or equal to 6 joules, required from a golfer to swing the golf club head through the air and reach club head speeds that are greater than or equal to 100 mph. Thus, a golfer, applying an amount of work to the club head designs disclosed herein that is substantially similar to that work applied to other club head designs, is able to achieve faster club head speeds with any one of the club head designs disclosed herein. The faster club head speeds allow the golfer to achieve longer golf shots.

The raised trailing edge 125 may raise the location of a club head CG. The present disclosure includes features and methods for positioning the club head CG in an optimal location, preferably within 2 mm of a neutral axis of the club head, where a neutral axis is an idealized axis passing through a center of, and normal to, the ball-striking face 105.

Figure 2:
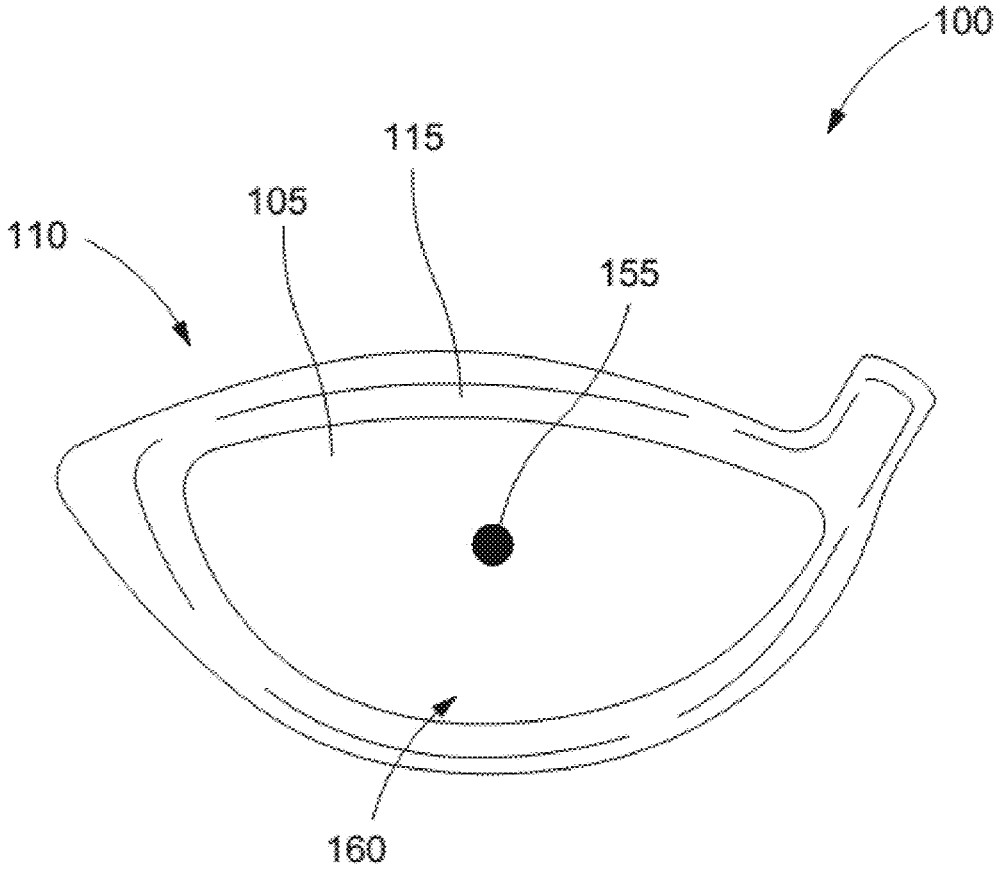
FIG. 2 is a front-view of the golf club head.

FIG. 2 is a front-view of the golf club head 100, showing a center point 155 of the ball-striking face 105. The ball-striking face 105 comprises a center point 155 at which energy transfer of an impact of a golf ball is maximized.

Club heads of the present disclosure feature trailing edge height that reduces drag during a golf swing compared to existing, prior art club heads.

Figure 3:
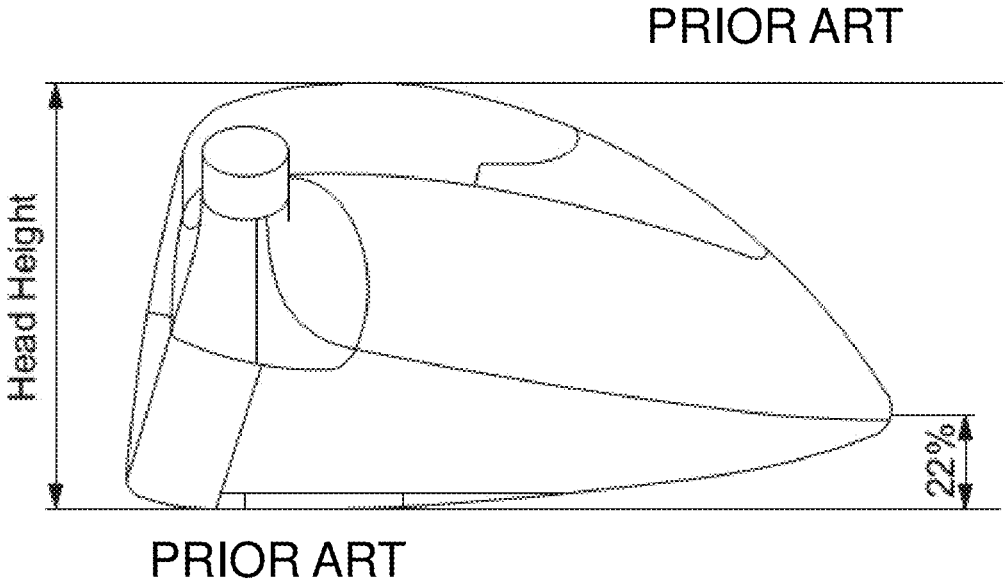
FIG. 3 illustrates a prior art club head with a low trailing edge.

FIG. 3 illustrates a prior art club head with a low trailing edge, the trailing edge height being about 22% of the head height as measured when the club is at address. Existing, prior art club heads may have trailing edge heights between about 17% and 30% when so measured. Golf club heads of the present disclosure have a trailing edge height higher than found in prior art club heads.

Figure 4:
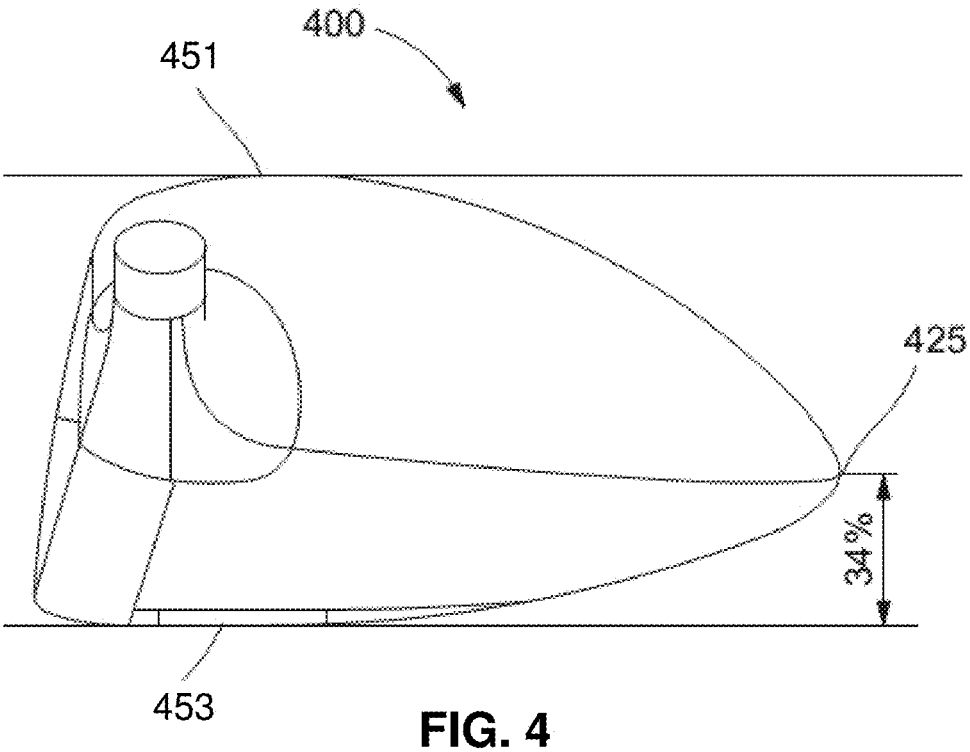
FIG. 4 shows a club head with a mid-height trailing edge.

FIG. 4 shows a club head 400 with a mid-height trailing edge 425 of about 34% of a height of the club head 400 as measured from apex 451 to nadir 453, when the club head 400 is at address. The club head 400 has a volume of about 459 cc and requires about 5.8 Joules of work to swing to 100 mph.

Figure 5:
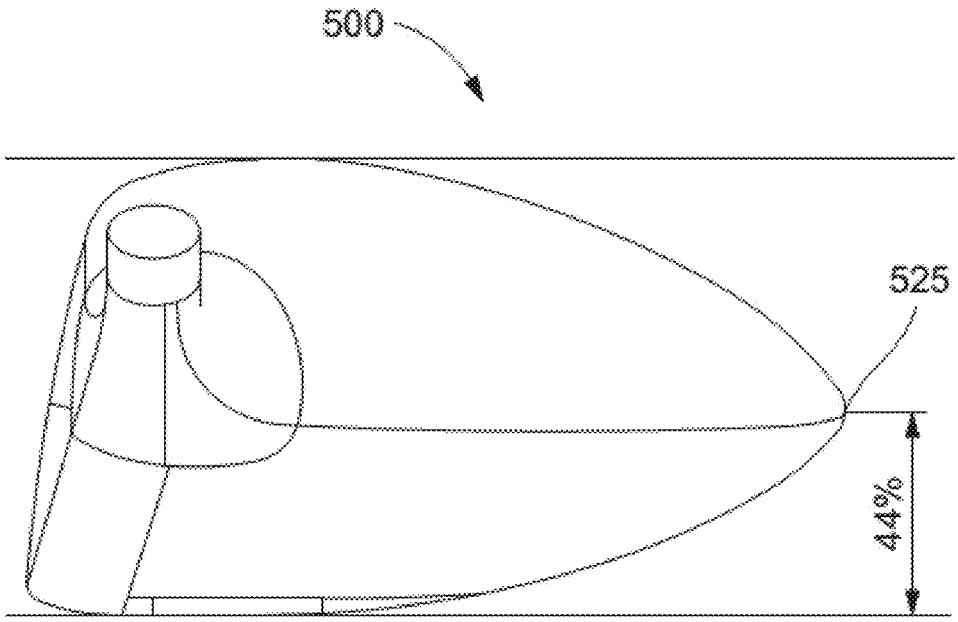
FIG. 5 shows a club head with a high trailing edge.

FIG. 5 shows a club head 500 with a high trailing edge 525 of about 44%. The club head 500 has a volume of about 459 cc and requires about 5.5 Joules of work to swing to 100 mph.

Figure 6:
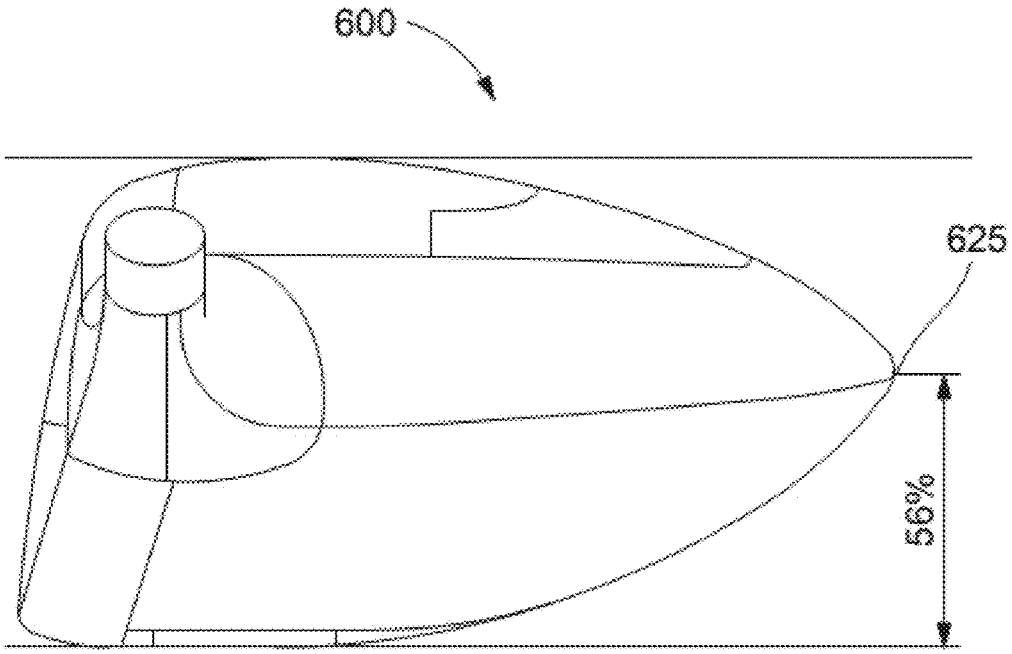
FIG. 6 shows a club head with a very high trailing edge.

FIG. 6 shows a club head 600 with a very high trailing edge 625 of about 56%. The club head 600 has a volume of about 459 cc and requires about 4.8 Joules of work to swing to 100 mph.

The raised trailing edge (compared to prior art club heads) of club heads 400, 500, 600 decreases drag on the club heads and an associated amount of required work for achieving speeds greater than or equal to 100 mph. Trailing edge height 425 is 34% of a height of club head 400 (i.e., a 22% TE/CH ratio) and requires approximately 5.8 joules (J) of work to achieve club head speeds greater than 100 mph. To offset any effect on CG of a raised trailing edge, the club heads 400, 500, 600 may include features that position the club head CG in an optimal location, preferably within 2 mm of a neutral axis of the club head, where a neutral axis is an idealized axis passing through a center of, and normal to, the ball-striking face 105.

Figure 7:
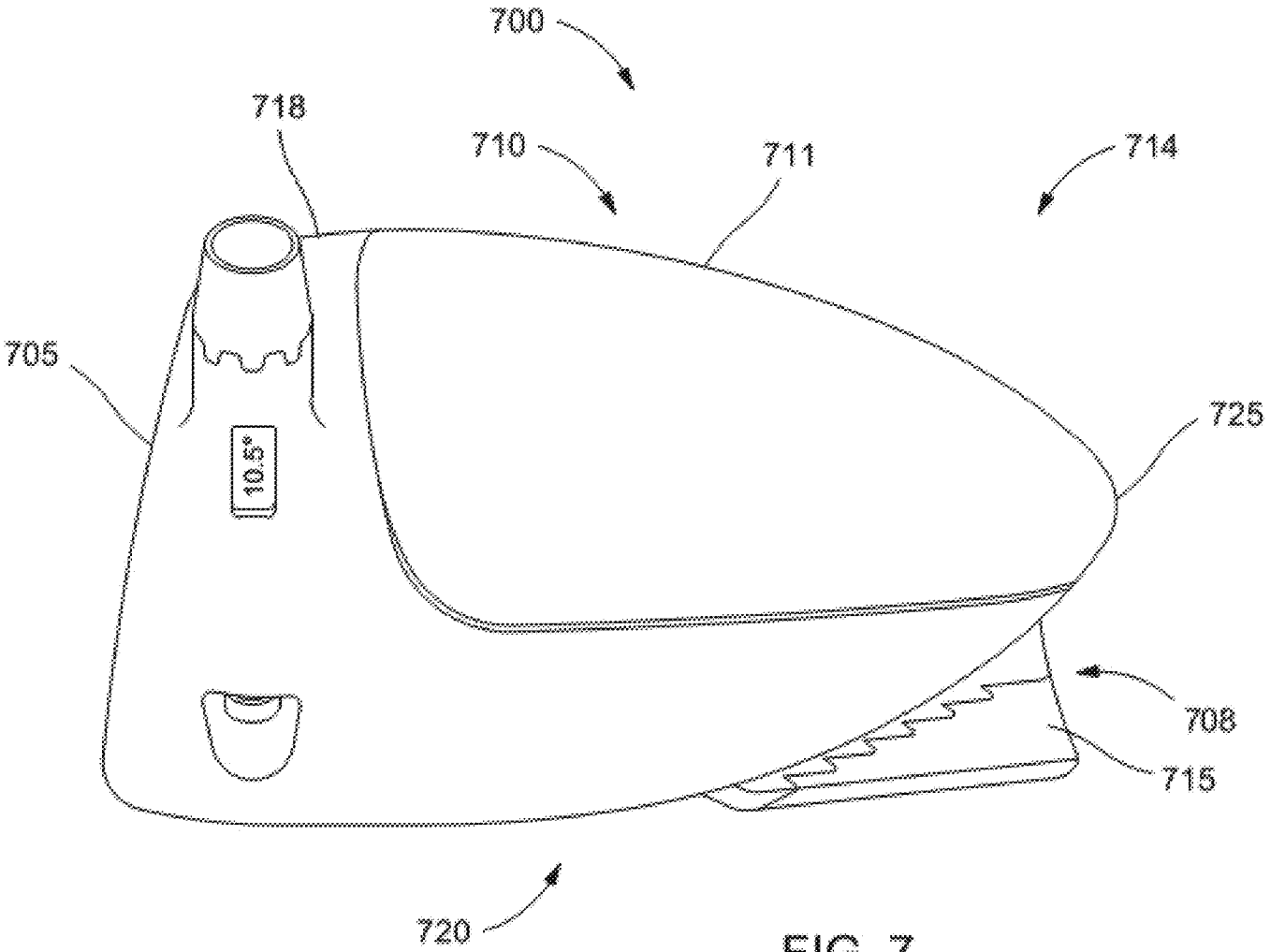
FIG. 7 is a side view of a club head with a protruding element with a weight member.

FIG. 7 is a side view of a club head 700 with a protruding element 708 with a weight member 715. The club head 700 includes a ball-striking face 705 with a crown 710 and a sole 720 extending back from the ball-striking face 705 and meeting at a trailing edge 725 to define an enclosed, hollow club head body 714. The club head 700 may optionally employ a multi-component construction in which a first body member 718 provides substantial portions of the sole 720 and the ball-striking face, and in which a crown piece 711 provides a substantial portion of the crown 711.

Figure 8:
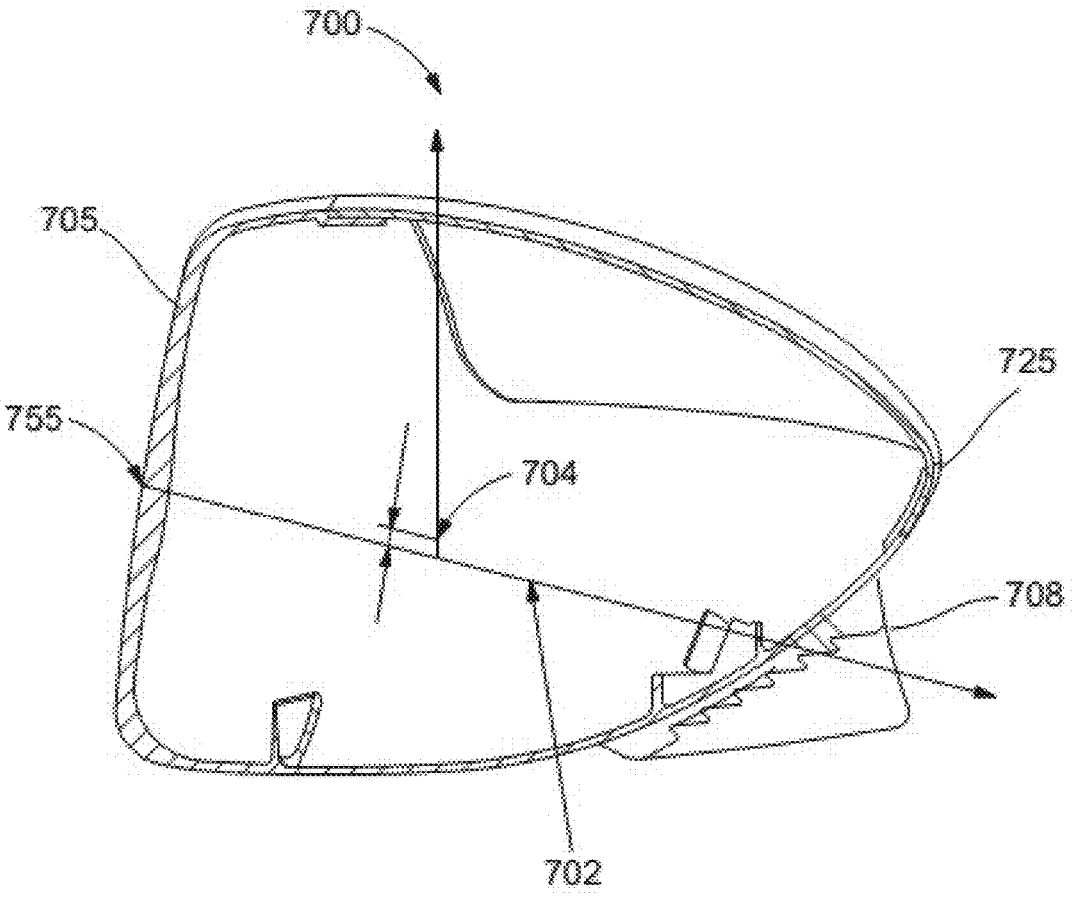
FIG. 8 is a cross-section through the club head with the protruding element.

FIG. 8 is a cross-section through the club head 700 with the protruding element 708 and the raised trailing edge 725. As shown, a club head CG 704 is located about 1.9 mm from a neutral axis 702 of the club head 700. The club head CG 704 can be defined by a vertical location (how high up the CG is from the sole), horizontal location (how far it is from the center of a club head's shaft in a hosel (not shown) of the head), and depth (how far back from the ball-striking face 705). In other examples, the CG can be defined based on horizontal/vertical locations with respect to a surface of the ball-striking face 705, and its depth into the club head 700 with respect to the face 705.

Ideally, the CG 704 should be positioned along and either on or about, e.g., within a few millimeters, the club head's neutral axis 702 for efficient energy transfer and to maximize its MOI. This neutral axis is normal to and passing through a center point 755 of the ball-striking face 705. For example, the neutral axis 702 is perpendicular to a surface (e.g., geometric plane) defined by the ball-striking face 705 and normal to a center 755 of the ball-striking face 705. The center 755 is a point of intersection of the face's 755 longest vertical and horizontal axes (not shown). This center point 755 can also define a point of origin for a vector of the neutral axis 702 which runs through the club head 700. The axes described herein are not physical components of the club head 700, and are idealized constructs used to aid in understanding the relationships among the depicted elements.

As illustrated, the CG 704 is located at a point that is a distance from the neutral axis 702, wherein the distance is preferably no more than about 7 mm, and more preferably no more than about 2 mm. Locating the club head CG 704 at most 7 millimeters (mm) away, at most 2 mm away, or between 2 mm and 7 mm from the neutral axis 704 maximizes energy transfer to a ball at impact.

Figure 9:
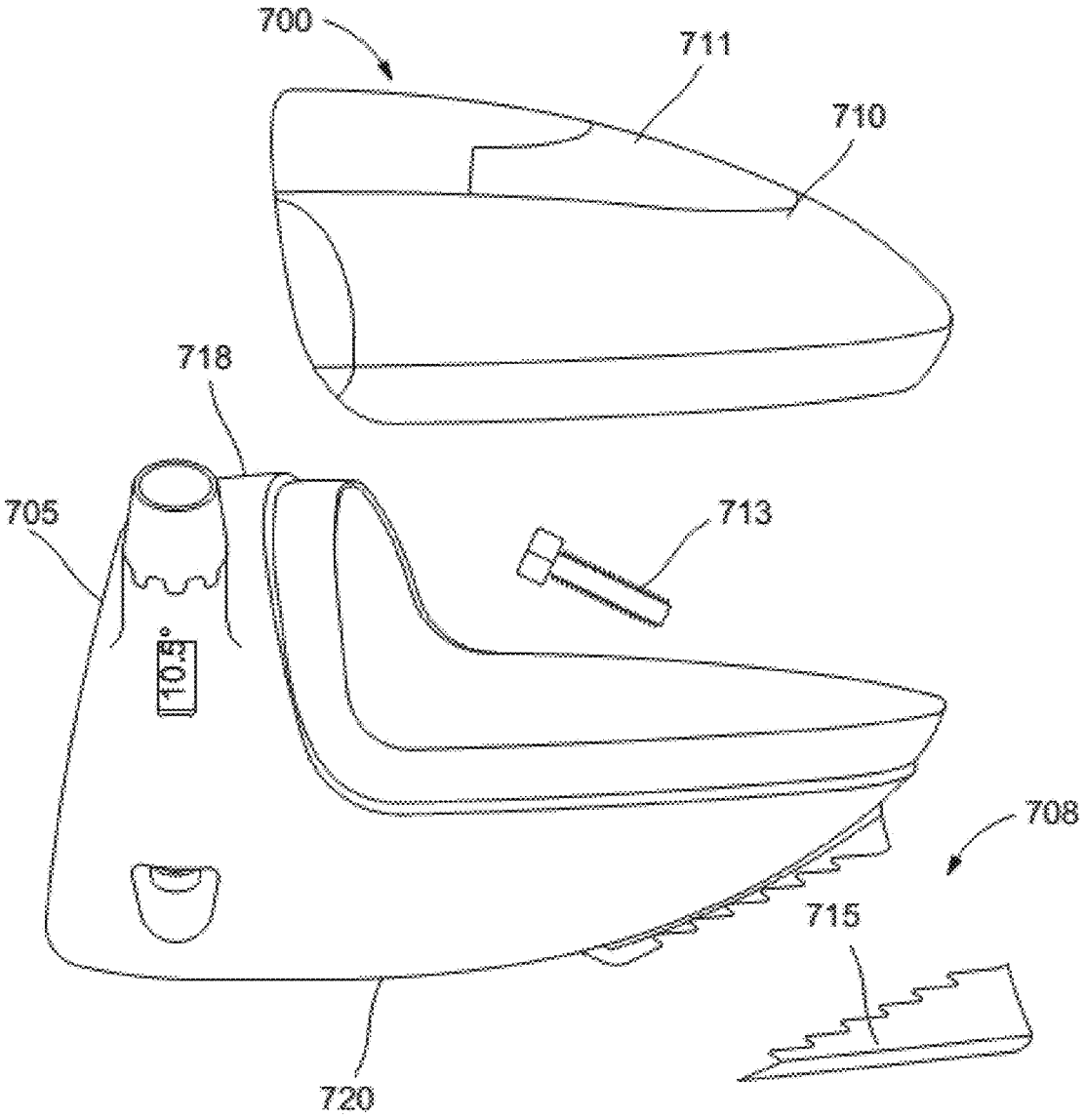
FIG. 9 is an exploded view of the club head with the protruding element.

FIG. 9 is an exploded assembly view of a club head 700. In the depicted embodiment, the club head 700 uses a multi-component construction in which a first body member 718 provides substantial portions of the sole 720 and the ball-striking face, and in which a crown piece 711 provides a substantial portion of the crown 710. Preferably, the body member 718 comprises a first material and the crown piece 711 comprises a second material. Part or all of the protruding element 708 may include a third material. For example, a portion of the protruding element 708 may be provided as a weight member 715 made of the third material. The weight member 715 may be coupled to the body member 718 via a screw 713, which itself may be mass-optimized or weighted through the use of a fourth material.

In certain embodiments, the first material used for the body member 718 is a metal alloy such as titanium, aluminum, or stainless steel. The second material used for the crown piece 711 is a plastic or composite (e.g., carbon fiber or graphite). The third material used for the weight member 715 is a material (e.g., lead or tungsten) having a density (e.g., about or greater than 11.34 g/cm3) greater than the first and second materials. The fourth material, for the screw 713, may be a metal or metal alloy such as stainless steel, lead, and tungsten. The weight of each of the first, second, third, fourth materials is selected to position the club head CG 704 at a position that maximizes the efficiency of the club head's transfer of energy to a golf ball at impact with the club head's ball-striking face 705.

In preferred embodiments, the crown piece 711 is bonded to the body member 718 and the protruding element 708 is coupled to an aft section of the sole 720. The skilled artisan will understand that any known mechanism can be used to bond the crown piece 711 to the body member 718. For example, any fastening means such as the use of adhesive, screw(s), snap fit means, and friction fit means can be used to bond the crown piece 711 to the body member 718. See U.S. Pub. 2017/0189770; U.S. Pub. 2012/0172147; U.S. Pat. No. 9,504,889; U.S. Pub. 2013/0178306; U.S. Pub. 2013/0178305; U.S. Pat. Nos. 6,969,326; 7,431,664; 7,361,100; U.S. Pub. 2007/0155533; U.S. Pub. 2004/0116207; and U.S. Pub. 2017/0001082, each incorporated by reference. Additionally, the weight member 715 of the protruding element 708 can be coupled to the sole 720 using a screw 713, which can be weighted to further optimize the club head's CG (e.g., the CG 704 of FIG. 7). The protruding element 708 can also be coupled to the sole 720 by any other means. For example, the skilled artisan also understands that the protruding element 708 can be coupled using any coupling means such as a sleeve fit, male/female interfaces, shaft coupling, snap fit means, and friction fit means.

Any suitable protruding member may be included to optimize a mass distribution of a club head of the disclosure; other embodiments are within the scope of the disclosure.

Figure 10:
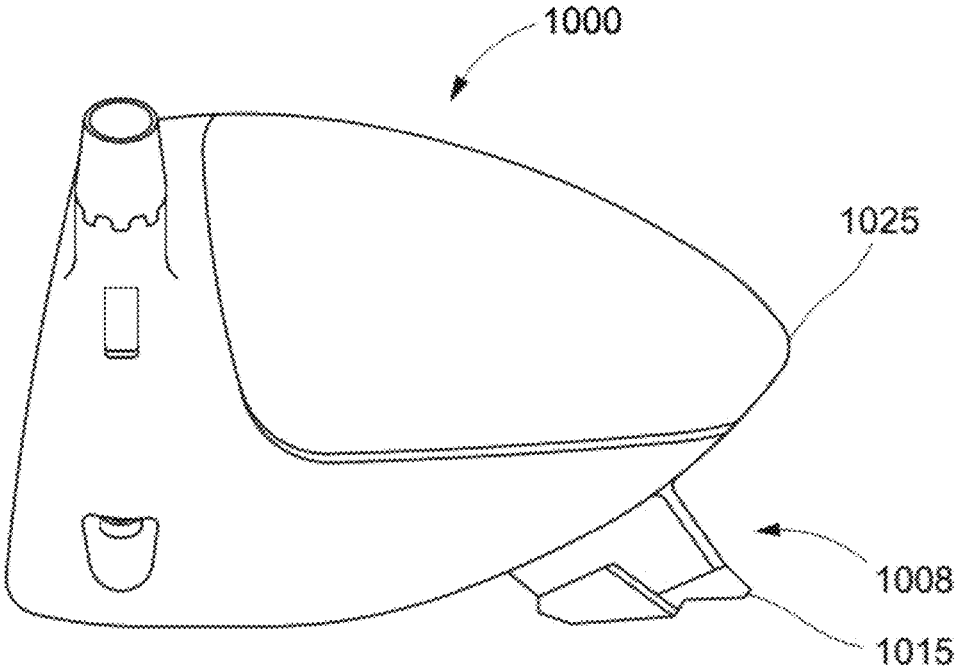
FIG. 10 shows a club head with a protruding element with a low CG weight member.

FIG. 10 shows a club head 1000 with a low protruding element 1008, which has a low CG weight member 1015, extending below the high trailing edge 1025.

Figure 11:
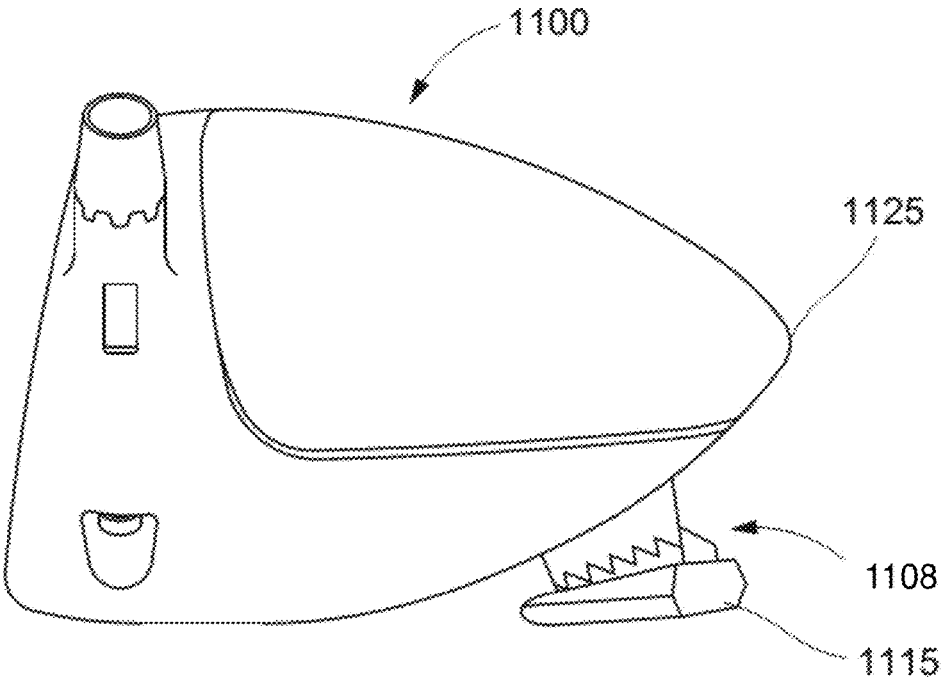
FIG. 11 shows a club head with a foot-style protruding element.

FIG. 11 shows a club head 1100 with a foot-style protruding element 1108, with a wide weight member 1115 positioned beneath a raised trailing edge 1125.

Club heads of the disclosure are designed with a trailing edge positioned at a height that minimizes drag during a golf swing, resulting in faster swing speeds. To offset any potential effect that the raised trailing edge may have on a location of the club head CG, the club heads may include a weighted protruding element extending from a sole of the club head. The club head aerodynamics are influenced by the height of the trailing edge and by a configuration of the protruding element. The protruding element may have an aerodynamic design to minimize drag on the club head during a golf swing. Aerodynamic models may show that club heads of the disclosure exhibit lower drag than prior art club heads.

Figure 12:
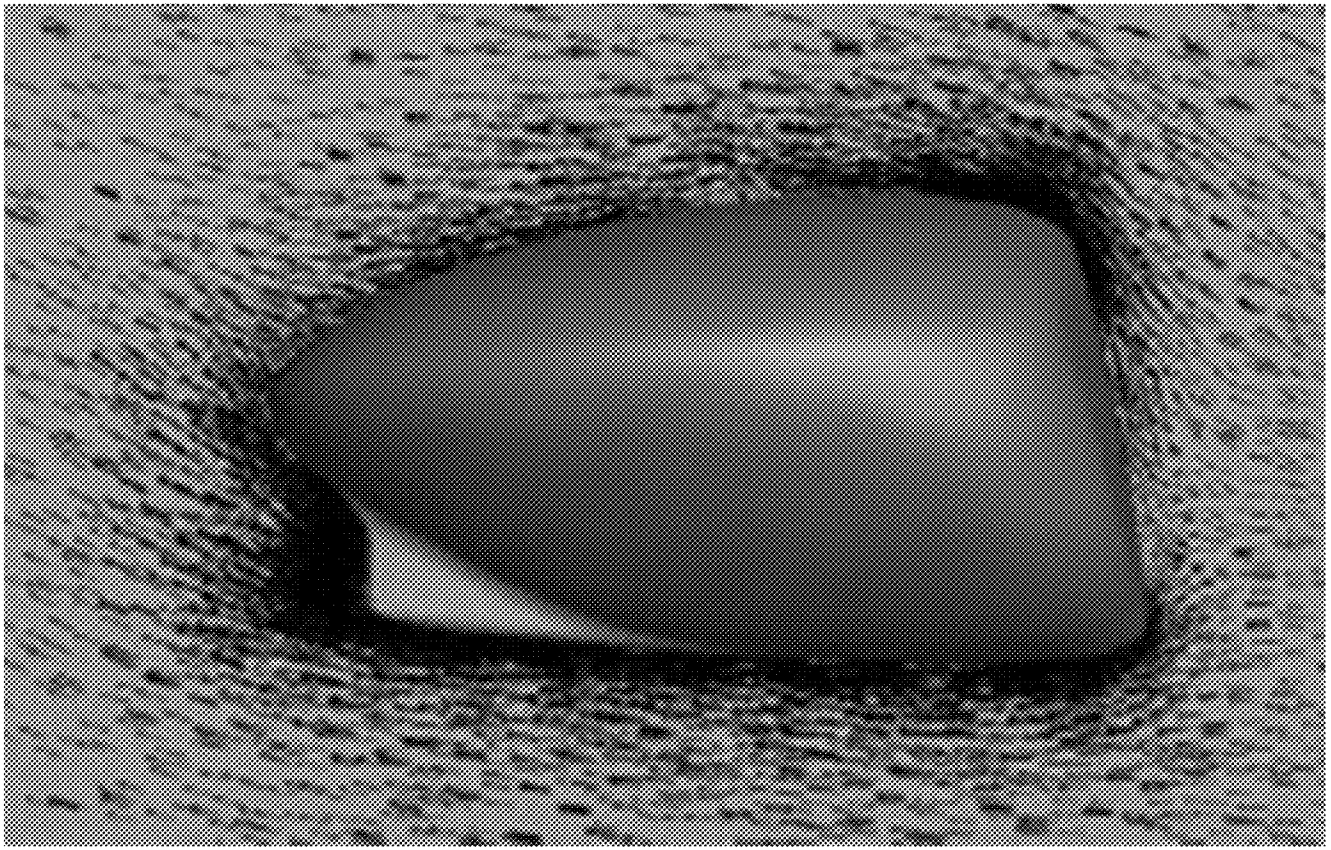
FIG. 12 illustrates aerodynamics of a golf club of the present disclosure.

FIG. 12 illustrates aerodynamics of a golf club of the present disclosure. An analysis was performed using Computational Fluid Dynamics (CFD) to validate effects on drag of features of the present disclosure. The CFD analysis shows that drag is reduced in club heads of the disclosure relative to prior art club heads. A Finite Element Analysis (FEA) validates that the energy transfer from the club head into a golf ball is optimized by the mass distribution of club heads of the disclosure.

By raising the trailing edge of the crown surface, club heads of the disclosure reduce drag force on the driver over a substantial portion of the swing and consequently reduce the amount of work to move the driver through the air, along a swing path, by almost 40%. Such improvements provide measurable performance in club head speed gains. Knowing the launch conditions have been compromised by the higher CG location, an effort has been made to keep the good aerodynamic design of the raised trailing edge combined with a desirable low CG location through the addition of an external weight on the sole of the club head to obtain high performance ball launch conditions. This creates a golf club delivering more kinetic energy to the ball due to a faster club head speed producing higher balls speeds and both high performance launch conditions from the relatively low CG position. Club heads of the disclosure add weight low (closer to the ground) and aft (further from the face) on the club head to achieve the optimal CG position with high MOI values. Club heads of the disclosure recognize restrictions in USGA driver volume, optimal head weight targets, and aerodynamic tendencies. Thus an optimal design is provided through the usage of very dissimilar materials positioned where their inherent strengths and properties yield a club head with unprecedented aerodynamic properties combined with highly desired mechanical properties (CG & MOIz). Club heads of the disclosure are faster when swung when compared to prior art club heads due to the low drag design of club heads of the disclosure. In addition, the transfer of energy from the faster moving club heads of the disclosure is received by the golf ball due to the optimally positioned CG and high MOI values. This efficient transfer of energy to the golf ball enables the golf ball to travel farther than with prior art head designs, everything else being equal. The present disclosure provides club heads that aggressively reduce air drag along a swing path with a highly engineered hitting face for golfers of all abilities to feel confident in making a full and fast swing into the ball.

Club heads of the disclosure have a shape that delays flow separation on the club head swing throughout the swing. Every surface of the driver has been engineered to help reduce aerodynamic drag throughout the swing path. Club heads of the disclosure have a pleasing sound (>3600 Hz) at impact and a design that positions club head CG at an optimal location for excellent energy transfer into the golf ball. This is achieved by positioning the CG very close to an axis perpendicular to the center of the face, running through the club head (i.e., the neutral axis). This is accomplished by using a larger than usual crown piece of a material such as graphite composite which replaces heavier titanium in the uppermost areas of the club head thereby pushing the CG lower in the club head.

In addition, a very dense weight member of a material such as tungsten is pendant from the sole and towards the aft of the club head to further lower the club head CG and to increase the club head's inertial properties to help reduce club head twisting on miss-hits to help transfer the kinetic energy of the club head more fully into the golf ball. The club head construction of a large, lightweight crown (e.g., graphite composite), bonded to a denser body member (e.g., titanium), and a heavy weight member (e.g., tungsten) affixed low on the head, makes for a low CG, high MOI driver coupled with the lowest drag body design on the market.

Club heads of the disclosure are improved over prior art club heads due to measurable aerodynamic improvements and the use of various materials to locate CG such that the club heads deliver head speed energy more effectively into the golf ball for increased ball velocity, desired launch angle, and lower backspin to obtain longer shots.

Figure 13:
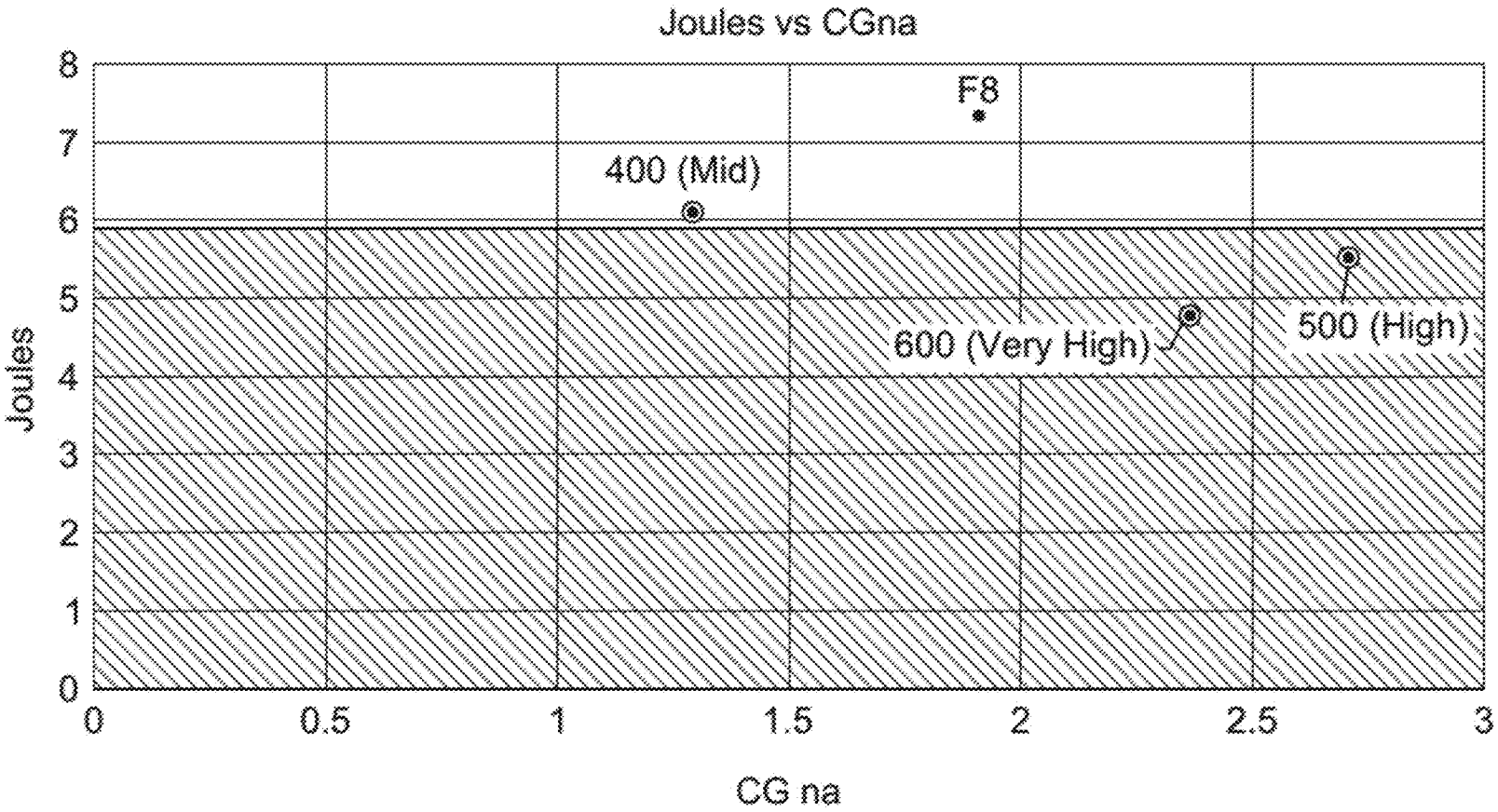
FIG. 13 shows work required in Joules to achieve swing speed of 100 mph.

FIG. 13 shows work required in Joules to achieve a swing speed of 100 mph for the club head 400 with a mid-height trailing edge 425, a club head 500 with a high trailing edge 525, and for the club head 600 with a very high trailing edge 625. A relationship between the trailing edge height of club head, club head height, CG position about a neutral axis, and work required due to reduced drag to achieve swing speeds greater than 100 mph is shown for the club head 400 (Mid; 34%), the club head 500 (High; 44%), and the club head 600 (Very High; 56%).

Table 1 shows the relationship between the position of a club head's CG and certain performance characteristics of the club head. As shown in Table 1, the CG is optimally positioned close to the neutral axis at a position that is back and down. However, as a trailing edge is raised with respect to a height of the club head, the CG is moved up. As such, the club head is weighted such that the CG can be positioned lower in the club head (i.e., closer to the neutral axis). As shown in Table 1, an optimal position of the CG can also result in the club head having a higher MOIz value.

TABLE 1

| Performance summary | | |
|---|---|---|
| Performance | | |
| | CG Forward | CG Back |
| Dynamic Loft | Decreases | Increases |
| Spin | Decreases | Increases |
| Closure Rate | Decreases | Increases |
| MOIz | Decreases | Increases |
| | CG Up | CG Down |
| Dynamic Loft | Decreases | Increases |
| Spin | Increases | Decreases |

The CG is influenced by a weight member of a protruding element, a material of the crown, and a material of a body of the club head.

The weighted protruding element is coupled to an aft section (e.g., at a location away from the ball striking face) of the sole. The protruding element can be made of a dense material such as tungsten, or another material of comparable density, such that a smaller amount of material is needed to optimally position the CG, and such that any drag benefits from raising the trailing edge is not deleteriously affected by the feature. The feature can have any geometry known to have low drag characteristics. For example, the feature may be fin shaped (e.g., similar to a shark's fin), or airplane tail fin shaped. A skilled artisan understands that the feature may have any geometry and shape that minimizes drag. The crown may include a crown piece made of a light-weight material such that upward movement of the CG due to raising the trailing edge is minimized. For example, the crown piece may include graphite composite or any material with similar characteristics. Additionally, the body may include titanium such that the weight does not adversely affect the CG position.

Figure 14:
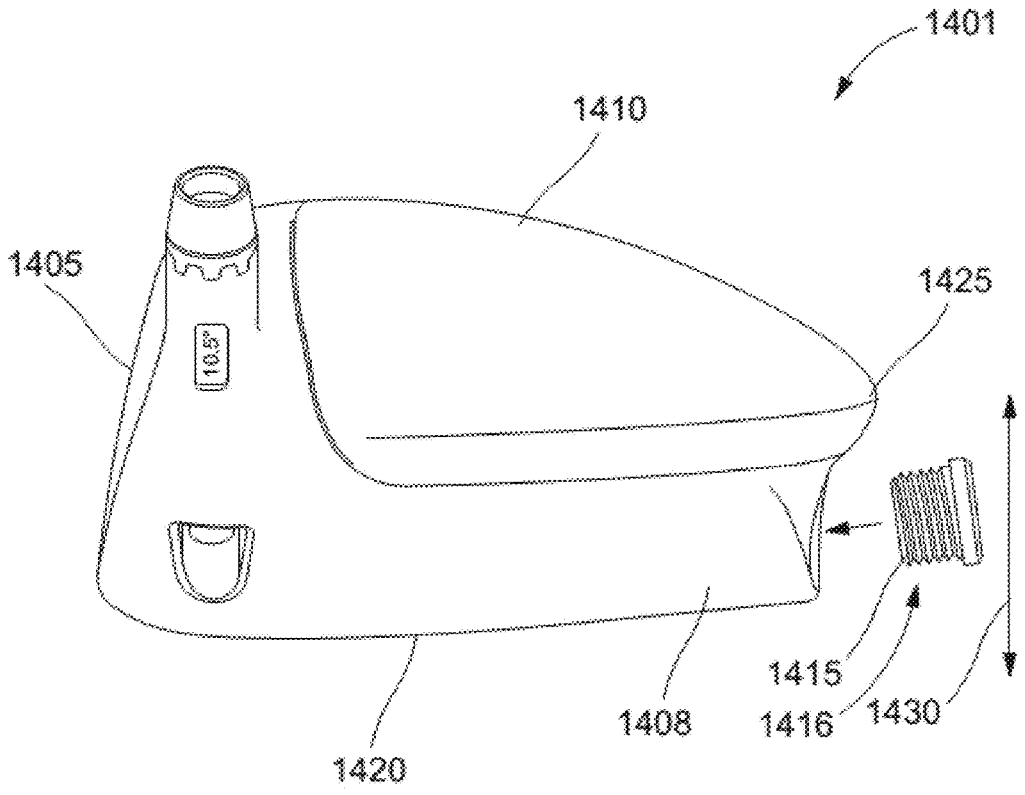
FIG. 14 shows an aft-weighted golf club head according to certain embodiments.

FIG. 14 shows an aft-weighted golf club head 1401 according to certain embodiments. The aft-weighted golf club head 1401 includes a ball-striking face 1405, a crown 1410 extending back from a top of the ball-striking face, and a sole 1420 extending back from a bottom of the ball-striking face 1405. A trailing edge 1425 is defined by a meeting of the crown 1410 and the sole 1420. A height 1430 of the trailing edge 1425, when the club head 1401 is at address, is selected to reduce drag the golf club head experiences during a golf swing. The golf club head 1401 has a protruding element 1408 as an extension of the sole 1420, as well as a detachable weight member 1415.

Here, the protruding element 1408 is provided as an integral medial ridge that arises from the base sole shape, made from the same, or other lightweight material as the body. This protruding element 1408 may be made in a tangential relationship to the sole surfaces or may diverge in a non-tangential relationship from the base sole surface shape. The protruding element 1408 is tangentially blended into, and allows for smooth transition from, the sole 1420 to allow the airflow that occurs during a swing to more easily pass over the lower portion of the club head with less drag.

Figure 15:
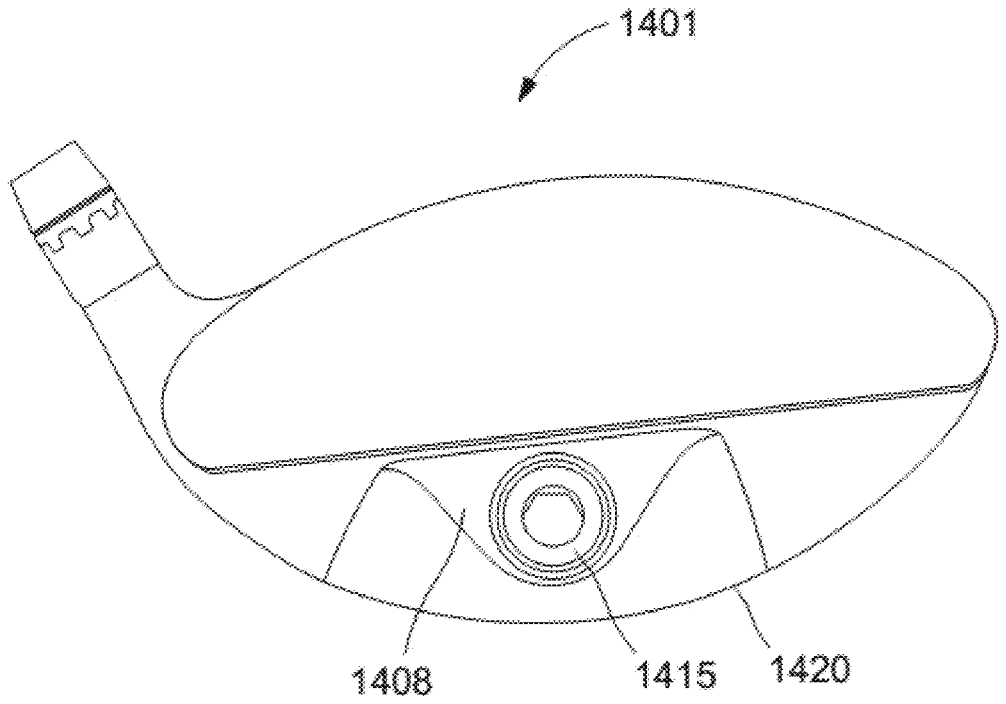
FIG. 15 shows a back view of the aft-weighted club head.

FIG. 15 shows a back view of the aft-weighted club head 1401, showing that the protruding element 1408 is an integral medial ridge that arises smoothly from the sole 1420. The protruding element 1408 is designed in a tangential and smooth blending design with the sole 1420 and can receive a weighting member 1415 of a density greater than the body material and more preferably with a density of around 15 g/cc and a weight varying between 20-30 grams. In this embodiment, it is advantageous to more securely hold the weight member 1415 securely in place, e.g., via a long threaded post 1416, to react the high forces that are exerted on the weight member 1415 during impact with the ball.

Due to the positioning of weight member 1415, the CG is positioned within a few millimeters of an axis normal to and passing through a center point on the ball-striking face 1405.

Figure 16:
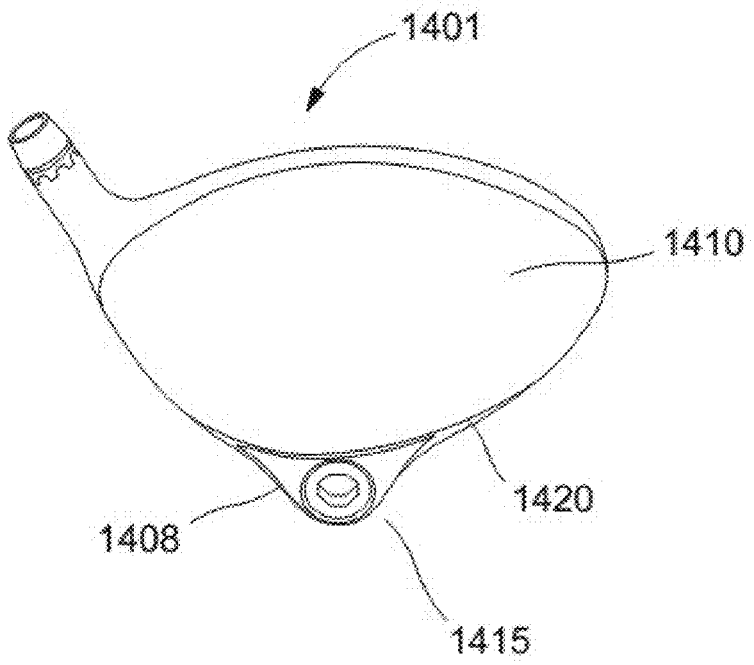
FIG. 16 is a rear perspective view of the aft-weighted club head.

FIG. 16 is a rear perspective view of the aft-weighted club head 1401. It can be seen that the protruding element 1408 extends gently from an aft section of the sole 1420. The weight member 1415 positions the CG at a low point along and either on or about the axis. In certain embodiments of the aft-weighted club head 1401, a portion of the crown 1410 is provided by a crown piece made of a lightweight material such as a composite or thermoplastic. Preferably, at least a portion of the protruding element 1408 (e.g., the weight member 1415) has a density that is about eleven grams per cubic centimeter or greater. The sole 1420 may be provided by a body member of a metallic material such as steel or titanium. A height 1430 of the trailing edge 1425 is between about twenty two percent and fifty six percent of a crown-to-sole height of the golf club head 1401 as defined when the club head is at address. The golf club head 1401 has a moment of inertia through a vertical axis of at least about 4800 gcm^2. Other embodiments are within the scope of the disclosure.

Figure 17:
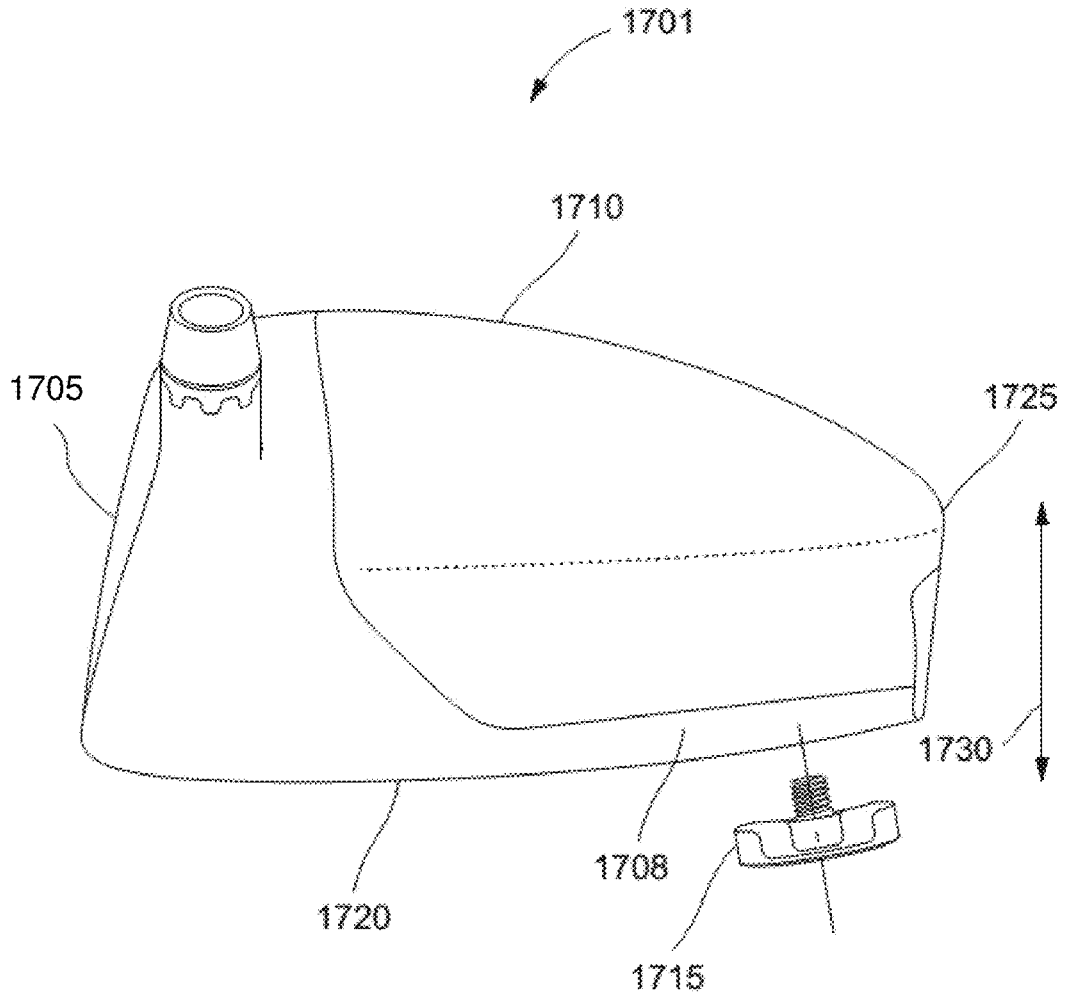
FIG. 17 shows a weighted aero club head according to some embodiments.

FIG. 17 shows a weighted aero club head 1701 according to some embodiments. The weighted aero club head 1701 includes a ball-striking face 1705 (mislabeled as 1405 in the figures) a crown 1710 extending back from a top of the ball-striking face 1705, a sole 1720 extending back from a bottom of the ball-striking face, and a trailing edge 1725 defined by a meeting of the crown 1710 and the sole 1720. A height 1730 of the trailing edge 1725 when the club head is at address is set to reduce drag that the weighted aero club head 1701 experiences during a golf swing. The weighted aero club head 1701 has a protruding element 1708 pendant from the sole 1720 with a weight member 1715 coupled to the protruding element 1708.

Figure 18:
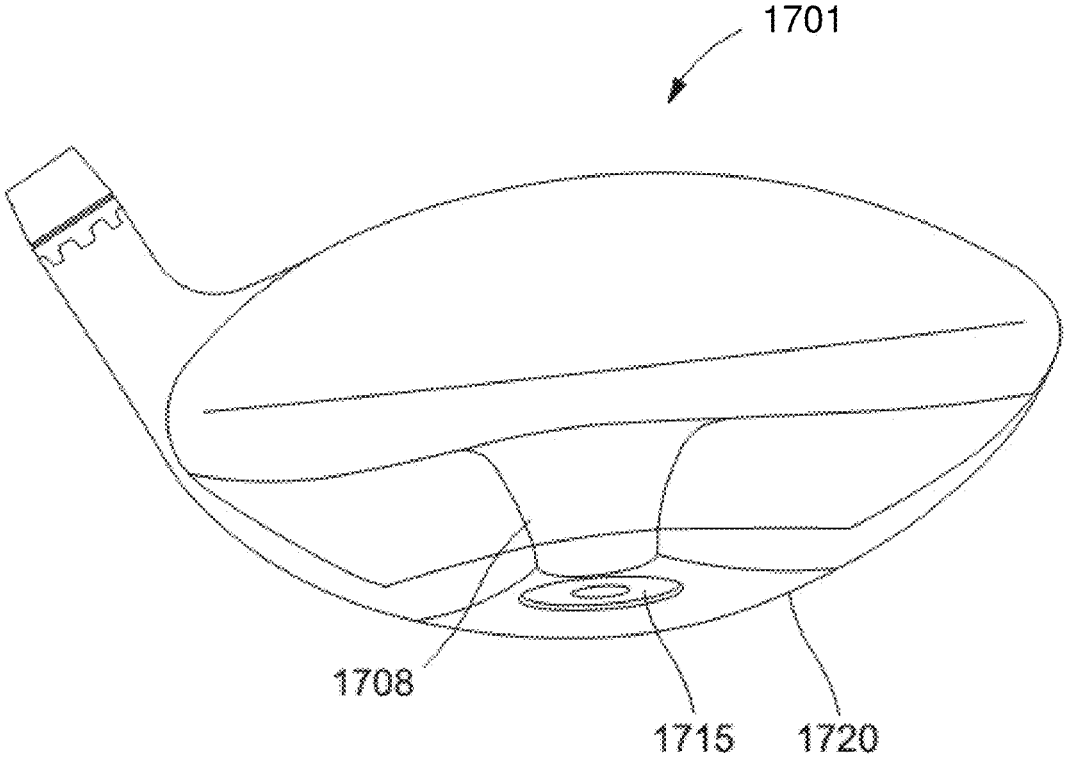
FIG. 18 is a back view of the weighted aero club head.

FIG. 18 is a back view of the weighted aero club head 1701. The protruding element 1708 depends from the sole 1720 as a styled integral shape, which may be made from the same, or other lightweight material as the body. The protruding element 1708 may be made in a tangential relationship to the sole surfaces or may diverge in a non-tangential relationship from the base sole surface shape. It is preferred that the protruding element 1708 is tangentially blended into, and allows for smooth transition from, the sole 1720 to allow any airflow that occurs during the swing to more easily pass over the lower portion of the club head 1701 with less drag. By virtue of the weighted member 1715, the CG is positioned within a few millimeters of an axis normal to and passing through a center point on the ball-striking face 1705.

Figure 19:
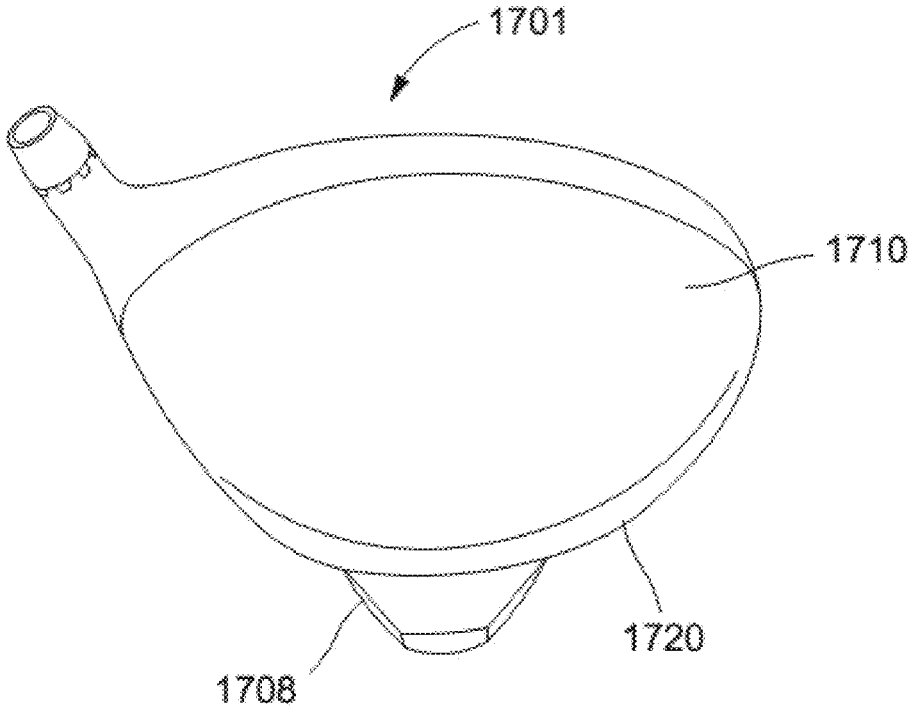
FIG. 19 is a rear perspective view of the weighted aero club head.
Figure 20:
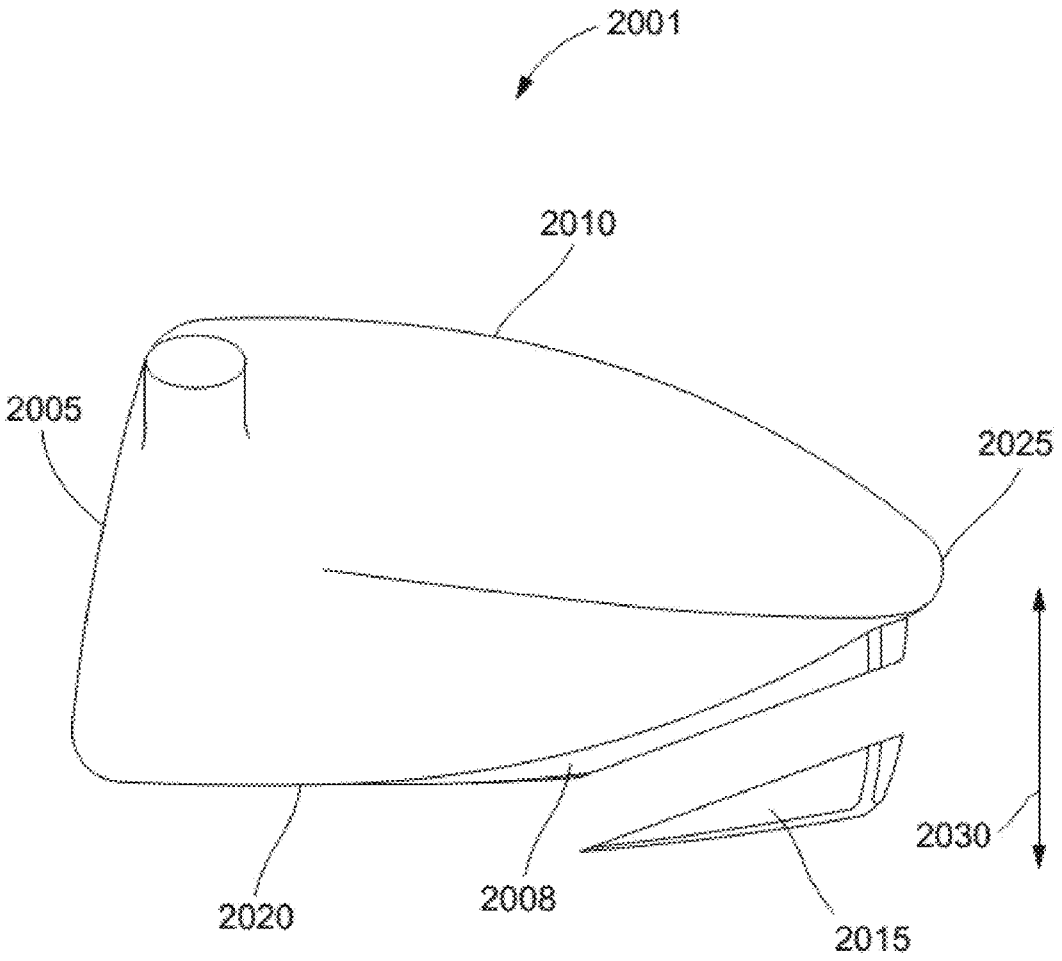
FIG. 20 depicts a ridge-weighted club head according to embodiments.

FIG. 19 is a rear perspective view of the weighted aero club head 1701 showing the protruding element 1708 pendant from an aft portion of the sole 1720. The weighted member 1715 has a mass that positions the CG at a low point along and either on or about the axis. The height 1730 of the trailing edge 1725 is preferably between about twenty two percent and fifty six percent of a height of the golf club head 1701 when the club head is at address. The golf club head 1701 may have a moment of inertia through a vertical axis of at least about 4800 gcm^2, FIG. 20 depicts a ridge-weighted club head 2001 according to embodiments. The ridge-weighted club head 2001 includes a ball-striking face 2005, a crown 2010 extending back from a top of the ball-striking face, a sole 2020 extending back from a bottom of the ball-striking face 2005, and a trailing edge 2025 defined by a meeting of the crown 2010 and the sole 2020. A height 2030 of the trailing edge 2025 when the club head 2001 is at address reduces drag the golf club head experiences during a golf swing. The ridge-weighted club head 2001 has a protruding element 2008 extending from the sole 2020 and coupled to a weight member 2015 to adjust a position of a club head center of gravity.

Figure 21:
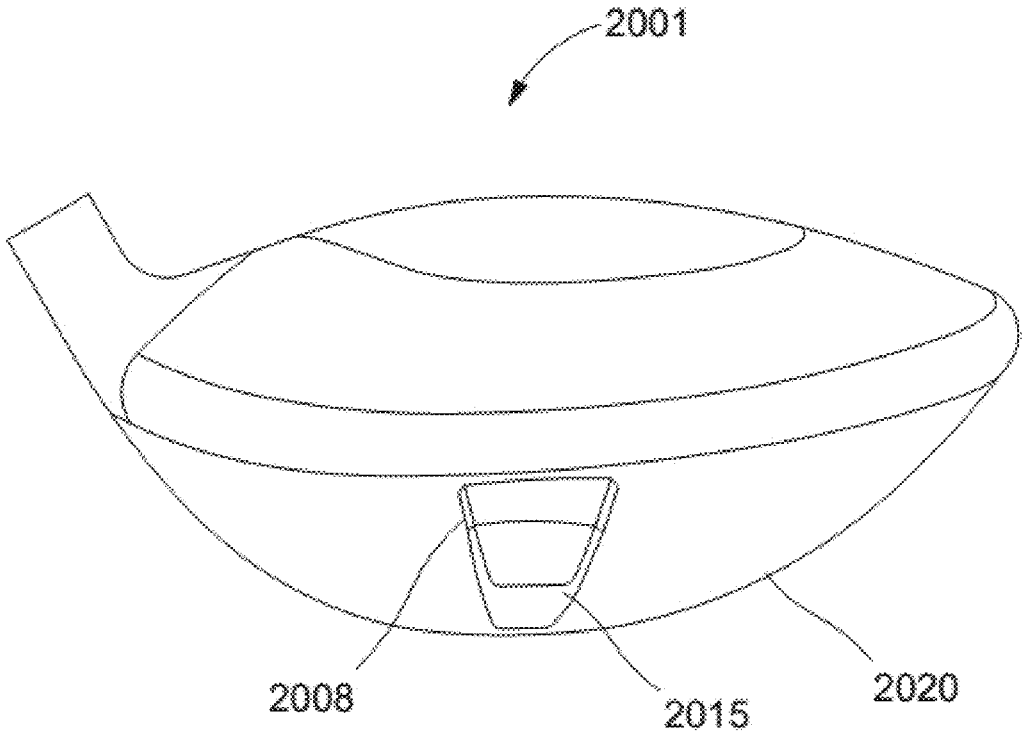
FIG. 21 is a back view of the ridge-weighted club head.

FIG. 21 is a back view of the ridge-weighted club head 2001 showing that the protruding element 2008 is describable as an integral medial ridge or styled integral shape that descends from the sole 2020. All or portions of (e.g., the weight member 2015) the protruding element 2008 may be made from the same, or other, lightweight material as the surrounding sole 2020. This protruding element 2008 may be made in a tangential relationship to the sole 2020 or may diverge in a non-tangential relationship from the base sole surface shape. It is preferred that the protruding element 2008 is tangentially blended into, and allows for smooth transition from, the base sole shape to allow airflow that occurs during a swing to more easily pass over the lower portion of the ridge-weighted club head 2001 with minimal drag. Due to the protruding element 2008 and the weighted member 2015, the CG is positioned within a few millimeters of an axis normal to and passing through a center point on the ball-striking face.

Figure 22:
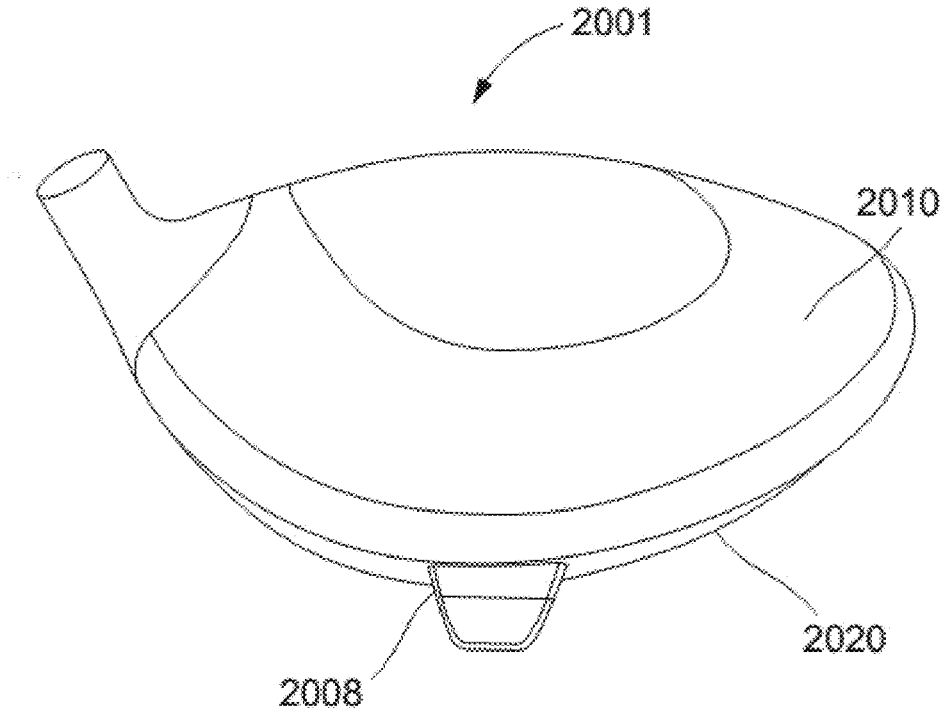
FIG. 22 is a rear perspective view of the ridge-weighted club head.

FIG. 22 is a rear perspective view of the ridge-weighted club head 2001 aiding in illustrating that the protruding element 2008 is coupled to an aft section of the sole 2020.

One skilled in the art will realize the invention may be embodied in other specific forms without departing from the spirit or essential characteristics thereof. The foregoing embodiments are therefore to be considered in all respects illustrative rather than limiting of the invention described herein. A scope of the invention currently being pursued is thus indicated by the appended claims, rather than by the foregoing description, and all changes that come within the meaning and range of equivalency of the claims are therefore intended to be embraced therein.

What is claimed is:

1. A golf club head comprising:

a ball-striking face;

a crown extending back from a top of the ball-striking face;

a sole extending back from a bottom of the ball-striking face and meeting the crown to define a trailing edge at a height between 44% and 56% of a height of the golf club head when at address, such that an amount of work required to achieve a golf club swing speed of 100 mph is less than or equal to 6 joules; and a strut protruding downwards from an aft of the sole with a weight of about 11 g/cm^3 density pendant from the sole at an end of the strut, by which means a club head center of gravity is located within 3 millimeters of an idealized axis passing through a center of and normal to the ball striking face.

2. The golf club head of claim 1 wherein a portion of the crown is provided by a crown piece that comprises a lightweight material.

3. The golf club head of claim 2 wherein the crown piece is bonded to a body member of the golf club head.

4. The golf club head of claim 3 wherein the body member comprises titanium.

5. The golf club head of claim 1 wherein the golf club head has a loft that is greater than or equal to 7 degrees and less than or equal to 10 degrees.

6. The golf club head of claim 1 wherein the golf club head has a moment of inertia through a vertical axis of at least about 4800 gcm^2.

7. The golf club head of claim 1 wherein the golf club head generates a sound that is greater than 3600 Hz in response to the ball-striking face impacting a golf ball.

8. A golf club head comprising:

a ball-striking face;

a crown and a sole both extending back from a top of the ball-striking face and meeting at a trailing edge at a height between 44% and 56% of a height of when the club head at address, such that an amount of work required to achieve a golf club swing speed greater than or equal to 100 mph is less than or equal to 6 joules; and a weight pendant from an aft section of the sole and connected to the aft section of the sole via a protruding strut such that a club head center of gravity is located within at most 3 mm of an idealized axis passing through a center of and normal to the ball-striking face.

* * * * *